US007519481B2

(12) United States Patent
Perrin et al.

(10) Patent No.: US 7,519,481 B2
(45) Date of Patent: Apr. 14, 2009

(54) SYSTEM AND METHOD FOR PREDICTING COMPATIBILITY OF FLUIDS WITH METALS

(76) Inventors: Glenn Perrin, 1623 Medway, Spring, TX (US) 77386; Jeffrey McKennis, 25 Wishbonebush Rd., The Woodlands, TX (US) 77380; Thomas S. Carter, 7 Villa Bend Dr., Houston, TX (US) 77069; Surendra K. Mishra, 7 Goldthread Ct., The Woodlands, TX (US) 77381

( * ) Notice: Subject to any disclaimer, the term of this patent is extended or adjusted under 35 U.S.C. 154(b) by 0 days.

(21) Appl. No.: 11/518,757

(22) Filed: Sep. 11, 2006

(65) Prior Publication Data

US 2008/0126383 A1 May 29, 2008

(51) Int. Cl.
*G01L 1/00* (2006.01)

(52) U.S. Cl. ..... 702/42; 702/34; 702/182; 422/53; 73/785; 73/788; 73/799

(58) Field of Classification Search ..... None
See application file for complete search history.

(56) References Cited

U.S. PATENT DOCUMENTS

| | | | | | |
|---|---|---|---|---|---|
| 3,919,884 | A * | 11/1975 | Gunderson et al. | ..... | 73/831 |
| 4,152,941 | A * | 5/1979 | Abou-Sayed et al. | ..... | 73/799 |
| 4,267,148 | A * | 5/1981 | Dickson et al. | ..... | 422/53 |
| 4,327,152 | A * | 4/1982 | Miller et al. | ..... | 428/419 |
| 4,823,606 | A * | 4/1989 | Malicki | ..... | 73/761 |
| 5,213,637 | A * | 5/1993 | Mallen Herrero et al. | ... | 148/598 |
| 5,369,675 | A * | 11/1994 | Diaz et al. | ..... | 376/249 |
| 5,405,513 | A * | 4/1995 | Lewis et al. | ..... | 205/775.5 |
| 5,676,820 | A * | 10/1997 | Wang et al. | ..... | 205/777.5 |
| 6,440,234 | B1 * | 8/2002 | Amaya et al. | ..... | 148/325 |
| 6,950,830 | B2 | 9/2005 | Obradovic et al. | | |
| 7,013,249 | B1 | 3/2006 | Davis | | |
| 2005/0038631 | A1 | 2/2005 | Steinke | | |
| 2006/0074912 | A1 * | 4/2006 | Borthakur et al. | ..... | 707/9 |
| 2006/0260412 | A1 * | 11/2006 | Saguto | ..... | 73/779 |
| 2006/0288794 | A1 * | 12/2006 | Hardwicke et al. | ..... | 73/763 |
| 2007/0266754 | A1 * | 11/2007 | Prevey | ..... | 72/53 |

OTHER PUBLICATIONS

Trillo et al. "Test Protocol Developmetn and Electrochemical Monitoring of Stainless Steels in Packer Fluid Environments" Mar. 2006, Corrosion NACExpo 2006, 61st Annual Conference and Exposition.*

(Continued)

*Primary Examiner*—Manuel L Barbee

(57) ABSTRACT

A method and system for selecting fluids for compatibility with specified metals exposed to oil field environments. Metal specimens are tested for corrosion and/or cracking behavior by exposing them to fluids under stressful test conditions. The testing is conducted under variable temperature, pressure, pH, fluid density, metallurgical stress, additives, cover gases and combinations thereof. The results from the stress testing are stored in a database. The test results are evaluated using encoded logic embedded in software media. Fluid compatibility evaluation software, developed from the stress test results, is executed to determine the cracking susceptibility of metals exposed to fluids under stressful conditions. A cracking susceptibility index can be developed to provide a quantitative indicator of cracking susceptibility. Fluid recommendation reports utilize the cracking susceptibility index values to rank compatible fluids. The reports also list optional additives to be used with the fluids.

33 Claims, 4 Drawing Sheets

OTHER PUBLICATIONS

Eason et al. "Modeling of Fatigue Crack Growth Rate for Ferritic Steels in light Water Reactor Environments", Nuclear Engineering and Design, Aug. 1998, vol. 184, No. 1, pp. 89-111.*

Eason et al. "Modeling of Fatigue Crack Grwoth Rate for Ferritic Steels in Light Water REactor Environments", Nuclear Engineering and Design, Aug. 1998, vol. 184, No. 1; pp. 89-111.*

Jin, L. Z. "The Chloride Stress-Corrsoion Cracking Behavior of Stainless Steels under Different Test Methods", Dec. 1994., Journal of Materials Engineering and Performance, vol. 3, No. 6, pp. 734-739.*

Eason et al. "Modeling of Fatigue Crack Grwoth Rate for Ferritic Steels in Light Water REactor Environments", Nuclear Engineering and Design, Aug. 1998, vol. 184, No. 1, pp. 89-111.*

Jin, L. Z. "The Chloride Stress-Corrsoion Cracking Behavior of Stainless Steels under Different Test Methods", Dec. 1994, Journal of Materials Engineering and Performance, vol. 3, No. 6, pp. 734-739.*

Eason et al. "Modeling of Fatigue Crack Growth Rate for Ferritic Steels in Light Water Reactor Environements", Nuclear Engineering and Design, Aug. 1998, vol. 184, No. 1, pp. 89-111.*

Elizabeth Trillo, Russell D. Kane, Jeffrey McKennis, Ken Shimamoto- Test Protocol Developement and Electrochemical Monitoring of Stainless Steels in Packer Fluid Environments, 2006.

* cited by examiner

Fig. 4

| Customer Supplied Information | | | | | |
|---|---|---|---|---|---|
| **Project Information:** | | | | | |
| Company Name: | | | Customer Contact: | | |
| Well Name: | | | Tetra Contact: | | |
| Well Location: | | | Well Type: | Not Known | |
| **Well Parameters:** | | | **Formation Properties:** | | |
| BHT: | 300 | °F | Mudline Temp.: | | °F |
| BHP: | | psia | Tubing O.D.: | | in |
| Hydrogen Sulfide: | 0 | ppm | Tubing Weight: | | lb/ft |
| Carbon Dioxide: | 0 | mol% | Bicarbonates: | | ppm |
| Casing Grade: | Not Known | | Chlorides: | | ppm |
| Tubing Grade: | JFE-13Cr80 | | pH: | | |
| Water Depth: | | ft | | | |

| Fluid Selection Parameters: | | | | | |
|---|---|---|---|---|---|
| Fluid Density: | 8.4 | lb/gl | TCT: | | °F |
| Inhibitor: | CORSAF SF | | Inhibitor Conc.: | 20 | gal/100bbl |
| Oxygen Scavenger: | OxBan HB | | Scavenger Conc.: | 5 | gal/100bbl |
| Biocide: | Biocide | | Biocide Conc.: | 1 | gal/100bbl |
| Fluid pH: | | | | | |

| TETRA Fluid Recommendation | | |
|---|---|---|
| **Packer Fluid:** | | **Sodium Bromide-Chloride** |
| **Cracking Susceptibility Index (CSI) Rating:** | | **GO - CSI is 10.4** |
| ***Scale 0-100*** | ***Go = <24*** | ***No Go = >24*** |

Comments:

In laboratory tests simulating these conditions, pitting or severe pitting was observed on the tubulars. This can be characterized as circular/hemispherical cavities formed due to the local breakdown of the protective surface film. It is likely the material will continue to pit rather than crack. It will be promoted by oxygen ingress into the annulus.

SYSTEM AND METHOD FOR PREDICTING COMPATIBILITY OF FLUIDS WITH METALS

FIELD OF THE INVENTION

This invention relates to a system and method for selecting one or more fluids that are compatible with metals in oil field environments.

BACKGROUND

Environmentally assisted cracking (EAC), which encompasses stress corrosion cracking and sulphide stress cracking, is a commonly observed phenomenon that results in the premature failure of metals. EAC is typically caused by the exposure of a sensitive metal to a corrosive environment and stress. If the corrosive environment or stress is absent, the metal will not crack. Stress, can be either residual, for example, from manufacturing, or applied, due to operations or improper handling.

Environmentally assisted cracking has caused severe structural failures over a broad range of industrial applications. This problem is particularly severe in the oil and gas industry, which has experienced a significant increase in EAC failures of production tubing or pipelines. These failures have predominantly occurred with martensitic and duplex stainless steel tubing with the cracks generally emanating from the annular side of the production tubing. This phenomenon is known as annular environmentally assisted cracking (AEAC). Failures of metal pipes have resulted in multi-million dollar expenses due to lost production time, replacement of production tubing and increased manpower and rig time utilization, among other factors. The prevention, prediction and control of EAC have assumed greater significance in recent years because of the increasing incidence of downhole tubing failures attributed to EAC. While various factors influence cracking, in most of these cases, cracking begins from the tubing's outer surface, rather than the inside.

The location of these cracks has led corrosion scientists to posit that the cracks are a result of corrosive packer fluids that interact with the metal tubing. However, there are no guidelines for the selection of fluids that are compatible with the various metals. As a consequence, the selection is made with limited information available from published literature or individual laboratory tests or is made based on pure conjecture due to lack of information.

Laboratory testing is typically conducted in accordance with NACE guidelines, wherein metals are subject to stress levels limited to the elastic region. These tests frequently involve non-representative fluids and test conditions that are not representative of those encountered in oil field applications. The duration of these tests may also be too long to be practical for the accumulation of a meaningful volume of test data, with test durations ranging from 14 days to 30 days for a standard test. The most common tendency, where the test data is lacking or is non-conclusive, is to select a relatively more expensive oil field fluid in order to minimize the risks of EAC and AEAC.

Previous selection of metals used in the oil and gas industry was done without substantive information on AEAC and the compatibility of various fluids with the common corrosion resistant metals used in production tubing. Particularly unfortunate has been the reliance on NACE methodologies, which involve non-representative fluids and well conditions, thereby leading to erroneous conclusions.

Consequently, in order to minimize the risk of metal tubing failures and to improve the economics of selecting compatible oil field fluids, there exists a need for a system that allows for a quick determination of these fluids that are compatible with the metals under corrosive oil field conditions.

SUMMARY OF THE INVENTION

In order to minimize the risk of tubing failure and to improve the economics of selecting optimal oil field fluids, a method and system is needed to enable the quick assessment of the compatibility of the various fluids with the diverse metals. The present invention provides a method and system that provides a well operator or well engineer the ability to select compatible fluids given certain metallurgical grades and key well parameters such as the bottom hole temperature, bottom hole pressure, carbon dioxide and hydrogen sulphide concentrations in the oil field fluids or gas, and required fluid density.

In one embodiment of the invention, a system for selecting fluids for compatibility with metals exposed to oil field environments is disclosed. C-ring metal specimens, optionally pre-stressed, and fluids are subjected to tests under stressful downhole conditions. The metals include martensitic or duplex stainless steel and other metals used in the oil field such as piping, tubing, tools, downhole tubular goods, and caps. The C-ring specimens are obtained from standard tubing and thus, include mill scales and intact markings. The fluids include various real-world fluids such as petrochemicals, completion fluids, drilling fluids, often referred to as muds, workover fluids, spike fluids, kill fluids, frac fluids, packer fluids, clear brine fluids and combinations thereof. The stress testing is conducted in accordance with a modification of a NACE C-ring test protocol. The stress testing can also be conducted in accordance with the NACE TM0177 C-ring test, or other methods known in the industry such as bent beam testing, SSRT, U-bend, electrochemical testing, acoustical testing and testing methodologies using loading bolts and strain gauges. The stress testing is conducted in corrosion resistant autoclaves such as C-276 autoclaves. The stress testing is conducted in accordance with a test protocol that studies well operating parameters and formation properties. The well operating parameters and formation properties comprise variations in temperature, pressure, metallurgical stress, pH, additives, fluid density and cover gases or contaminants and combinations thereof. The additives include corrosion inhibitors, biocides, hydrogen sulphide and oxygen scavengers at downhole concentration levels. The testing conditions are monitored using various commonly available equipment.

Electrochemical stress test monitors monitor the stress test results in real-time. The test results are stored in a computer database. The test results comprise data on cracking and pre-cracking events that may eventually lead to corrosion and cracking and include localized corrosion, sever localized corrosion, pitting and the absence thereof. The test results are evaluated with logic encoded in one or more media, such as software programs loaded in a computer memory. Computer processors execute the logic to determine susceptibility towards corrosion and cracking of the metals exposed to the fluids under stressful conditions. This facilitates the prediction of fluids that are compatible with metals exposed to oil field environments. Reporting the compatibility of a selected fluid with a specific metal can be accomplished in several ways. One system comprises a cracking susceptibility index to determine the cracking susceptibility for the fluid and metal combinations. The cracking susceptibility index is a range of numerical values between 0 and 100. A numerical value greater than 25 is indicative of a greater susceptibility towards corrosion and cracking. The cracking susceptibility index can also comprise a range of alphabetical values. Alternatively, the software program can simply report whether or not a specific fluid is a "go" or "no go" for use with a designated metal.

In another embodiment, the test results are evaluated and the logic is executed to generate a cracking resistance index. The cracking resistance index is a range of values between 0 and 100, wherein values greater than 25 are indicative of a greater resistance towards corrosion and cracking.

In yet another embodiment, the test results are evaluated and the logic is executed to generate a corrosion susceptibility index. The corrosion susceptibility index is a range of values between 0 and 100 with values greater than 25 indicative of a greater susceptibility towards corrosion.

In another embodiment, a system for selecting fluids for compatibility with metals exposed to oil field environments includes a computer with a computer memory, one or more processors, a database and stress test evaluation software, fluid compatibility evaluation software and fluid recommendation report generation software loaded into the computer memory. The system also includes metal specimens that are tested for corrosion behavior with fluids under applied and/or residual stress. The metal specimens tested include C-ring shaped specimens, which may or may not be pre-stressed. The C-rings are highly stressed to incorporate both elastic deformation and plastic deformation to simulate the stressful conditions that oil field metal tubing is exposed to downhole. The stress testing is carried out in an apparatus such as a corrosion resistant autoclave. The apparatus for stress testing can also include one or more loading bolts and one or more strain gauges. The test results, including changes in corrosion and cracking behavior, are monitored in real-time by an electrochemical apparatus. During testing, the C-ring specimens are subjected to conditions including variations in temperature, pressure, pH, metallurgical stress, fluid density, cover gases and combinations thereof. The cover gases or contaminants include naturally occurring contaminants such as oxidants, nitrogen, air, hydrogen sulphide and/or carbon dioxide. With the exception of nitrogen, these contaminants are found in the oil field environment.

The test results are stored in the computer database. The test results are evaluated with the stress test evaluation software loaded in the computer memory. Fluid compatibility evaluation software is developed from the stress test evaluation software. The fluid compatibility evaluation software presents a user interface containing one or more screens. The screens include input fields for well parameters and fluid parameters. The well parameters include bottom hole temperature, hydrogen sulphide concentration, carbon dioxide concentration and metallurgical grade of the one or more metals. The fluid parameters include fluid density and additives for the fluids. The fluid compatibility evaluation software is executed using the computer processors to determine a metal's susceptibility to cracking or corrosion. The determination can be a simple "go" or a "no go," or a cracking susceptibility index for ranking the interaction between the metals and fluids can be generated. The cracking susceptibility index is displayed on the user interface screen. The cracking susceptibility index is a range of arbitrary values that represent a quantitative susceptibility towards cracking. An arbitrary cracking susceptibility index value is designated as a cutoff value, such that cracking susceptibility index values above the designated value are indicative of a greater susceptibility to cracking. The cracking susceptibility index is used to predict one or more fluids compatible for use with the metals under stressful conditions. The fluid recommendation report generation software in the computer memory generates fluid recommendation reports that contain a ranking of the fluids based on the cracking susceptibility index values. The reports also contain a list of one or more optional additives recommended for use with the metals. The additives are determined by software instructions loaded into the computer memory.

In another embodiment, a computer system for predicting fluids compatible with metals in oil field environments is disclosed. The computer system includes a computer, a database for storing test results from stress testing metals and fluids under simulated downhole environmental conditions. The test results are evaluated with software code embedded in one or more media, such as a software program. The test results are used to develop fluid compatibility evaluation software that is used to depict susceptibility towards cracking for the fluid and metal combinations. The fluid compatibility evaluation software includes one or more user interface screens that contain a section for customer specified input values, including well parameters and fluid parameters. Susceptibility towards cracking can be displayed in another section of the user interface screen. The cracking susceptibility can be depicted by one or more words, characters, symbols, icons, colors, cracking susceptibility indexes and combinations thereof. The computer system also includes a report generation software program to generate one or more fluid recommendation reports. The reports also contain a listing of optional additives recommended for use with the fluids.

In another embodiment, a method for selecting fluids for compatibility with metals exposed to oil field environments is disclosed. The method comprises stress testing a combination of metals and fluids under simulated downhole conditions. The metals tested are those that are commonly used in oil field piping, tools, caps, downhole tubular goods, and equipment. The fluids include a sampling of real-world fluids, such as petrochemicals, completion fluids, drilling fluids, workover fluids and packer fluids. The fluids are also tested with commonly used additives, such as corrosion inhibitors, biocides and hydrogen sulphide and oxygen scavengers. The additives are at downhole concentration levels.

C-ring specimens are obtained from standard metal tubing, and can be used with mill scales and intact markings or without. The downhole conditions tested include variations in temperature, pressure, pH, metallurgical stress, fluid density, cover gases and combinations thereof. The cover gases include air, hydrogen sulphide and/or carbon dioxide gases. The stress testing is conducted in accordance with a modification of a NACE C-ring test protocol. During the stress testing, C-ring metal specimens are placed within the test fluids in a corrosion resistant autoclave. The stress testing can also be conducted in accordance with the NACE TM0177 C-ring test, or other methods known in the industry such as bent beam testing, SSRT, U-bend, electrochemical testing, acoustical testing and testing with loading bolts and strain gauges. The test results are stored in a computer database. The database includes pre-cracking corrosion data and cracking data. The pre-cracking corrosion data includes localized corrosion, severe localized corrosion and pitting. Software programs, loaded into a computer memory, are developed to evaluate the test results stored in the database. Computer processors execute the software programs to determine susceptibility towards cracking of the metals exposed to the fluids under stressful conditions. This facilitates the prediction of fluids that are compatible with metals exposed to oil field environments. Determination of cracking susceptibility can be accomplished by means of a cracking susceptibility index. The cracking susceptibility index ranks the cracking susceptibility for the fluid and metal combinations. The cracking susceptibility index is a range of numerical values between 0 and 100. A cracking susceptibility index value greater than 25 is indicative of a greater susceptibility towards corrosion and cracking. On the other hand, cracking susceptibility index values lower than 25 are indicative of a lower susceptibility towards corrosion and cracking. The cracking susceptibility index can also include a range of alphabetical values.

In another embodiment, the software programs, loaded into the computer memory, evaluate the test results stored in the database to generate a cracking resistance index that is used to predict the resistance to cracking of the metals exposed to the fluids. The cracking resistance index is a range of numerical values between 0 and 100. A cracking resistance index value greater than 25 is indicative of a greater resistance to corrosion and cracking. On the other hand, cracking resistance index values lower than 25 are indicative of a lower resistance to corrosion and cracking.

In another embodiment of the invention, a method for predicting cracking susceptibility of one or more metals exposed to one or more fluids that optionally comprise one or more additives under either applied or residual stress is disclosed. The method comprises developing a database comprising test results from stress testing the compatibility of fluids with metals under simulated oil field conditions. The test data can also be stored in data arrays and other data structures. It is to be appreciated, that these and/or other data structures can also be utilized throughout the various embodiments of the present invention. The test results are evaluated to determine susceptibility towards cracking for the metal and fluid combinations. The cracking susceptibility can be depicted by one or more indicia comprising colors, icons, words, characters, symbols, indexes or combinations thereof.

In another embodiment of the invention, a method for selecting fluids for compatibility with specified metals exposed to oil field environments is disclosed. The fluids comprise petrochemicals, completion fluids, drilling fluids, workover fluids and packer fluids. The metals comprise metals used in oil field tools, equipment, tubing, tools, downhole tubular goods, caps and piping. The method comprises providing a computer or a comparable data acquisition and data processing system. The computer consists of a computer memory, processors, a database, an input/output device such as a mouse and keyboard, a display terminal and software programs such as stress test evaluation software, fluid compatibility evaluation software and fluid recommendation report software. Metal specimens are tested for corrosion behavior by exposing them to fluids under test conditions that comprise applied and or residual stress. C-ring metal specimens are highly stressed to give both elastic deformation and plastic deformation. The testing is conducted under variable temperature, pressure, pH, fluid density, metallurgical stress and cover gases or combinations thereof. The testing conditions further incorporate downhole contaminants such as naturally occurring contaminants such as oxidants, air, hydrogen sulphide and/or carbon dioxide. The fluids tested optionally contain additives such as corrosion inhibitors, biocides and hydrogen sulphide and oxygen scavengers. The stress testing is monitored in real-time using one or more apparatus or equipment. The corrosion results are monitored in real-time by an electrochemical apparatus. The variations in pressure, pH, temperature and gas concentration are also monitored by equipment and apparatus commonly used in the industry. The stress testing is conducted in highly corrosion resistant apparatus such as C-276 or titanium autoclaves. The results from the stress testing are stored in the computer database. The stress test results are evaluated using software programs loaded into the computer memory. Fluid compatibility evaluation software is developed from the stress test results and is loaded into the computer memory. The fluid compatibility evaluation software comprises a user interface screen divided into two sections, a section for inputting information, section A, and another for displaying results, section B. The input fields are designed to receive one or more well parameters and fluid parameters. The well parameters include bottom hole temperature, hydrogen sulphide concentration, carbon dioxide concentration and metallurgical grades of the metals. The fluid parameters comprise fluid density and one or more additives for the fluids. The input section of the user interface also comprises fields designed to receive well specific information. Computer processors execute the fluid compatibility evaluation software to generate a cracking susceptibility index that is used to predict fluids compatible for use with the specified metals. The cracking susceptibility index is a range of values that represent a quantitative relative susceptibility towards cracking. An arbitrary value is designated as a cutoff value for the prediction of fluids compatible with specified metals. Cracking susceptibility index values above the cutoff value indicate a greater susceptibility towards cracking for the given fluid and metal combination. Report generation software loaded into the computer memory can generate fluid recommendation reports based on the cracking susceptibility index. The fluid recommendation reports rank the fluids based on the cracking susceptibility index. The computer also has additive selection software loaded into memory. The processors execute the additive selection software to provide a report on optional additives for the fluids.

BRIEF DESCRIPTION OF DRAWINGS

FIG. 4 depicts an exemplary report generated with the invention.

DETAILED DESCRIPTION OF THE INVENTION

Environmentally assisted cracking (EAC) or annular environmentally assisted cracking (AEAC) are known to be among the more serious causes of cracking failure of oil and gas piping. EAC causes a premature failure in metals through the combined interaction of stress (applied and/or residual), a sensitive metal, and a corrosive environment, for example, one involving either sulphide and/or halide compounds that may be found in oil field fluid environments.

Figure 1:
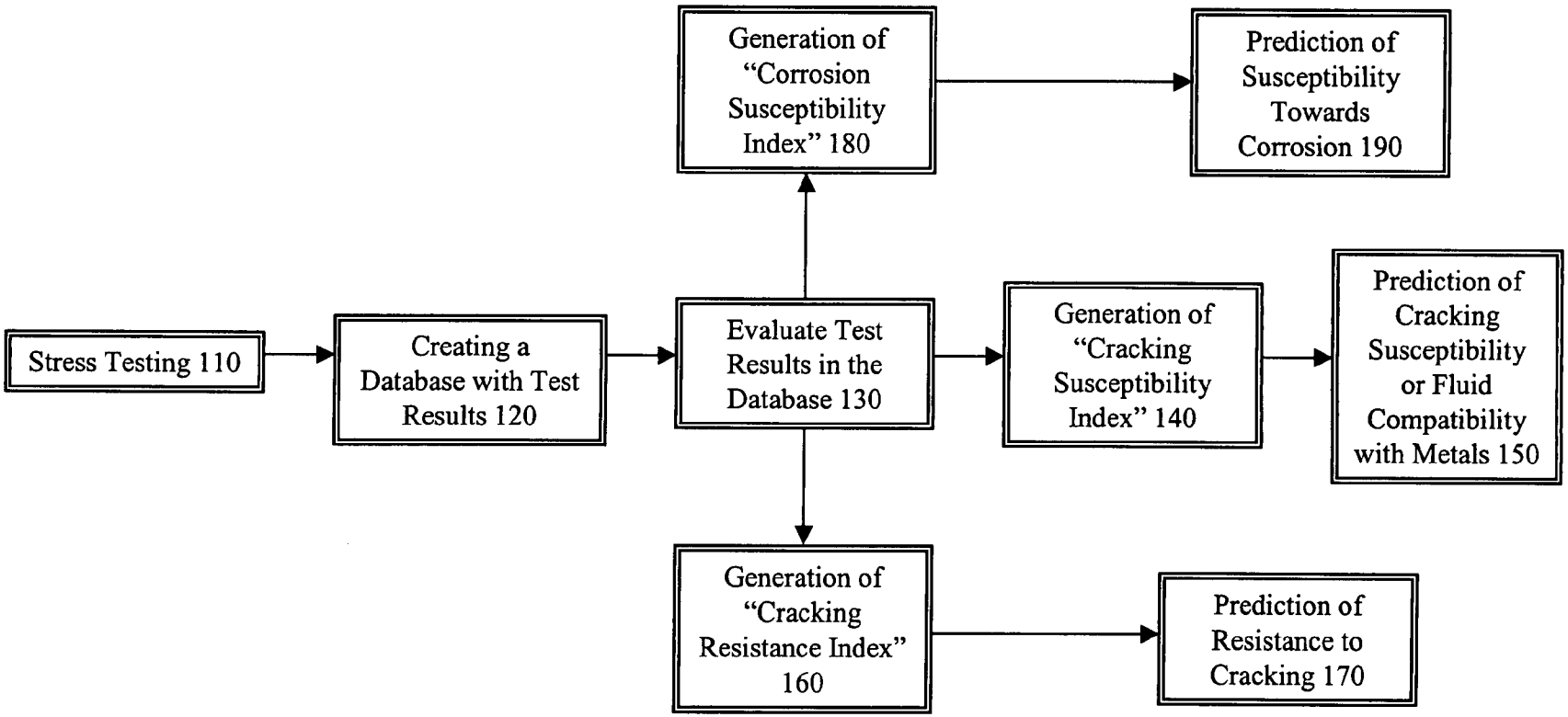
FIG. 1 illustrates a flow chart of one embodiment of this invention.

The present invention provides a method and system for the selection of oil field fluids compatible with metals used downhole to minimize risks associated with EAC or AEAC pipe failure under stressful conditions. FIG. 1 illustrates a flow diagram of the invention that is applicable to the embodiments of this invention.

Referring to FIG. 1, in one embodiment of this invention, non-generic stress tests 110 are performed to provide data regarding corrosion, EAC and AEAC behavior of various metals exposed to the fluids to be tested under conditions simulating downhole environments. The results from the stress tests are stored in a database 120. The database of test results 120 is then used to identify corrosive behavior that could lead to tubular failure. The stress test results are evaluated to derive logic that is then encoded and embedded in media 130 such as a software program. The logic is executed to determine susceptibility towards cracking of the metals exposed to the fluids under stressful conditions. This facilitates the prediction of fluids that are compatible with metals exposed to oil field environments.

The step of stress testing 110, used in one embodiment of this invention, is fully described in a paper by Jeffrey McKennis, Elizabeth Trillo, Russell D. Kane and Ken Shimamoto titled "Test Protocol Development and Electrochemical Monitoring of Stainless Steels in Packer Fluid Environments," presented at Corrosion NACExpo 2006, March 2006. The paper is incorporated herein by reference in its entirety.

In this embodiment, the stress testing 110 is conducted in accordance with a modification of the NACE C-ring test (NACE TM0177, Method C). The stress testing 110 can employ any of several methodologies, such as those outlined in NACE TM0177 ("NACE test"). However, many of these methodologies do not generate the requisite data, on the compatibility of fluids and the metals they are in contact with, in a reasonable quick time frame and the test conditions do not simulate the downhole conditions that are a prerequisite for EAC. Therefore, although possible, they would not be the preferred methodology of testing.

In the modified NACE test, stress testing 110 of the metal specimens and fluids is conducted in one or more autoclaves (not shown) comprising highly corrosion resistant alloys such as C-276 or titanium. The metal specimens, often in the form of C-rings, are placed in an autoclave with fluids to be tested for compatibility. The stress testing 110 is accelerated by applying stress levels ranging from 80 to 98 percent of actual tensile strength to cause both elastic and plastic deformation of the metals. The C-rings can be used as cut from the metal specimens or they can be pre-stressed prior to placing them in the autoclave. This simulates the downhole stressful conditions to which metal tubing is often exposed. The increase in the stress levels, incorporating both high elastic and plastic deformation, aids in accelerating the test duration and thus permitting test durations comprising a 7-day duration or less. The standard NACE C-ring test, in contrast, requires a 30-day duration, while other industry testing has involved a 14-day duration.

The one or more autoclaves can be run simultaneously. The corrosion resistant autoclaves are constantly monitored. The autoclave environment is adjusted to simulate downhole conditions. Variations in corrosion tendencies with time can be electrochemically monitored using an automated electrochemical apparatus. An example of such an electrochemical device is SmartCET® manufactured by Honeywell Process Solutions. The electrochemical monitoring produces a near continuous record during the stress tests and facilitates a quantitative evaluation of the corrosion rate and localized corrosion tendencies.

Alternatively, the apparatus for stress testing comprises one or more loading bolts and one or more strain gauges attached to the C-ring specimens. The C-ring specimens are placed in the autoclave along with the fluids and subjected to simulated downhole conditions. Signs of pitting, localized corrosion and cracking are observed visually and this data is recorded to show time other factors pertaining to failure.

Tests are conducted over temperatures ranging from 35° F. to 450° F. to simulate the harsh, variable conditions encountered in downhole conditions. One or more specimens of the metals are placed in the autoclaves with the fluids. The fluids comprise a sampling of real-world fluids. These fluids include petrochemicals, completion fluids, drilling fluids, often referred to as muds, workover fluids, spike fluids, kill fluids, frac fluids, packer fluids and clear brine fluids. The fluids have a density between 8.3 lb/gal and 20.5 lb/gal. The fluids are not specialty blends but rather are obtained from companies that manufacture the blends. Thus, they are representative of the fluids used in the oil fields. This is in contrast to the NACE tests that use a sodium chloride fluid acidified by acetic acid, a fluid not representative of the fluids found in the oil fields.

Figure 2:
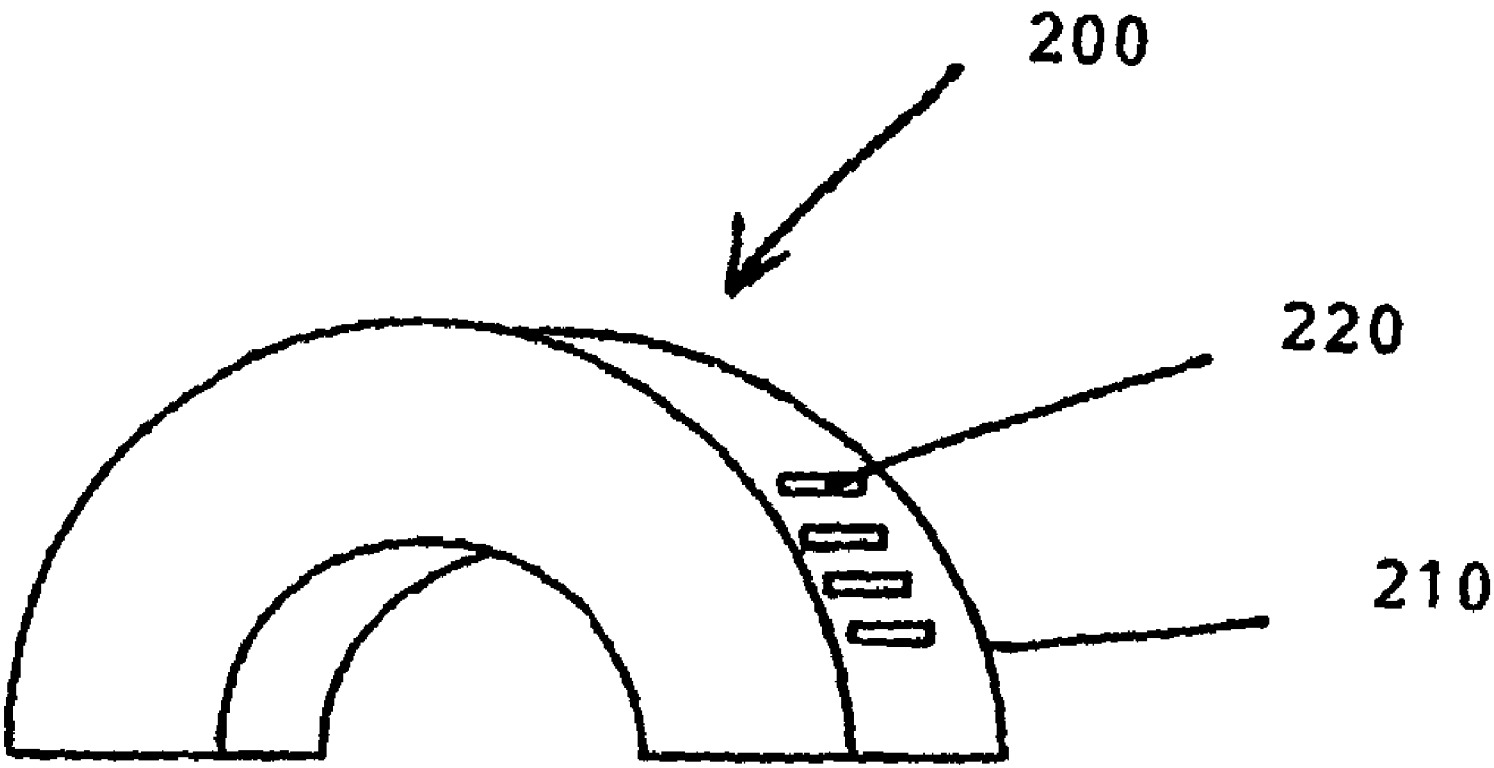
FIG. 2 depicts a C-ring specimen of the invention.

The metals tested include commonly used metallurgical grades and can comprise martensitic and duplex stainless steel and other metals typically used in oil field piping, tubing, caps, downhole tubular goods, tools and equipment. As illustrated in FIG. 2, the specimens used for testing have a C-ring shape 200. The C-rings 210 are cut from standard metal tubing used in oil field operations. In one embodiment, the C-rings 210 are left with their outside diameter unfinished, that is, with the mill scales and markings left intact 220, to simulate the metals used in oil field operations. This is in contrast to the standard NACE C-ring testing where the rings are finished on all sides, that is the mill scales and markings are removed. Stressing of the C-ring specimens 210 is accomplished by the use of loading bolts comprising corrosion resistant alloys, for example, C-276. Before stressing the actual specimens, strain gauges were applied to the outer diameter of the test specimen to obtain the strain/deflection curve for the C-ring geometry used with the stress test of this embodiment. Upon completion of each stress test, the C-rings 210 can be visually and microscopically examined to determine their condition, and categorized as exhibiting cracking, pitting, localized, severe localized corrosion, or none of the preceding.

To simulate downhole conditions, the stress testing 110, referring to in FIG. 1, is carried out with variations in temperature, pressure, metallurgical stress, pH, additives and cover gases or contaminants. For example, pH can vary from pH 0 to 14, pressure from ambient pressure to 500 psi, and stresses can be as high as approximately 99% of the actual tensile strength (ATS). The test concentrations or partial pressures of the gases mimic the worst case scenario where production gases may freely flow into the annulus, or when such gases are generated within the fluid from additives, contaminants or bacterial action. The fluids can, in contrast to much of current stress corrosion testing, optionally comprise additives such as corrosion inhibitors, hydrogen sulphide and oxygen scavengers, and biocides at downhole concentration levels. The fluids can also contain various contaminants such as naturally occurring contaminants such as oxidants, nitrogen, air, carbon dioxide and hydrogen sulphide. These cover gases, with the exception of nitrogen, represent the contaminants found in the fluids under downhole conditions. These and other real-world contaminants are introduced into the fluids to simulate potential real-world conditions, including a possible leak of the gases into the annulus and the packer fluid. The concentrations or partial pressures of the gases are designed to mimic even the worst case scenario when the production gases freely flow into the annulus, or when the gases are generated within the fluids from additives, contaminants or bacterial action.

Referring to FIG. 2, upon completion of stress testing, the C-rings 210 can be visually and microscopically examined to determine their condition, and categorized as exhibiting either cracking, pitting, localized corrosion, severe localized corrosion, or none of the preceding. The C-rings 210 are analyzed to identify elements that lead to failure, for example, did the failure occur at a specific temperature or pressure, or if these parameters were held constant, did the failure occur due to the introduction of a cover gas or an additive.

As illustrated in FIG. 1, the results from the stress testing are analyzed and stored in a database 120. The development of a reliable and extensive database 120 is advantageous to evaluate the cracking compatibility of the one or more fluids with the one or more metals under oil field conditions. In one embodiment, the stress test database 120 comprises stress test results from over 3,500 stress tests. The stress test database 120 stores compatibility data on twenty or more fluid combinations with six or more metals, and an array of additives and contaminants, such as naturally occurring contaminants such as oxidants, air and other cover gases, tested under a variety of well condition parameters.

In contrast to much of the published EAC data, in which normally only the cracking incidents are documented, the stress test database 120 stores pre-cracking data in addition to the cracking compatibility data from the stress tests 110. The pre-cracking data includes data on localized corrosion, severe localized corrosion, and pitting. These types of corrosion processes are important with respect to EAC or AEAC behavior since in many cases cracking is preceded by localized corrosion or pitting. Pitting frequently precedes cracking. Although pitting doesn't necessarily lead to cracking, it potentially can lead to failure and is representative of poor fluid/metallurgy compatibility.

By way of non-limiting example, the database 120 can be implemented by any commercially available database with sufficient memory capacity. Various data formats, such as Structured Query Language (SQL), can be used for accessing and storing data to the database 120. In addition, information that is stored in database 120 can be backed up or stored on a wide variety of storage medium, such as magnetic tape, optical disk or floppy disks. The database 120 is periodically updated with results from the stress testing 110.

In this embodiment of the invention, the system further comprises a computer (not shown) or a comparable data acquisition and data processing system. The computer contains a processor or CPU, a memory and the database 120 loaded into the computer memory. The volume of data in the database 120 makes manual querying of the data and interpolation between conditions for matching the one or more metals with compatible fluids a challenging task. To better facilitate the use of the database 120, encoded logic 130, embedded in one or more media, is applied to the test results stored in the database 120. The logic is developed by assigning, either alphabetical or numerical, values to the test data. For example, pitting data can comprise a value of A, severe localized corrosion comprises a value of B and cracking comprises a value of C. These values are summed and the resulting figure can be divided by a weighted factor to normalize the values to scale. The logic is encoded in one or more computer readable media which comprise software programs loaded into the computer memory.

The computer processors execute the encoded logic to determine susceptibility towards cracking of the metals exposed to the fluids under stressful conditions. This facilitates the prediction of fluids that are compatible with metals exposed to oil field environments. The cracking susceptibility for metals exposed to fluids under stressful conditions can be assessed by assigning values, for example, "pass" or "fail" or "go" or "no go", to the compatible and incompatible fluids, respectively. One or more unique words, colors, characters, symbols or the like, can also be utilized to indicate fluids that are compatible, or not, with the metals under downhole conditions.

One or more cracking susceptibility indexes can also be created to rank the cracking susceptibility for the fluid and metal combinations 140. The cracking susceptibility index is used to predict the susceptibility towards cracking of the metals exposed to fluids 150 under downhole conditions. The cracking susceptibility index provides an accurate and consistent ranking for identifying one or more oil field fluids incompatible with the metals used downhole in oil field related activities. The index is used to match the metals with optimally compatible oil field fluids under parameters simulating the actual environment to which the metals are exposed. In one embodiment, the cracking susceptibility index comprises values between 0 and 100 with cracking susceptibility index values over 25 indicative of a high risk of EAC and/or AEAC associated metal failure. On the other hand, a combination with a low cracking susceptibility index value, that is, a value below 25 would point to a low failure risk. The cracking susceptibility index can also be designed to comprise a range of alphabetical values.

In another embodiment, referring again to FIG. 1, the stress testing 110 is performed in an apparatus, such as an autoclave, where the metals and fluids are subject to simulated downhole conditions. The results from the stress testing are stored in a database 120. The database 120 can be, as a matter of convenience, located at the testing facility. Logic encoded in one or more software programs is applied to the stress test results 130. The stress test results in the database 120 comprise both pre-cracking data and cracking data for various fluid and metal combinations under simulated downhole conditions. The logic is executed to generate a cracking resistance index 160. The cracking resistance index 160 is used to predict the resistance to cracking of metals 170 exposed to the fluids under stressful downhole conditions. The cracking resistance index is a scale that varies, preferably, between 0 and 100. The cracking resistance index for any given metal and fluid combination varies between 0 and 100. Values of cracking resistance index below 25 are considered unacceptable and indicate a lower resistance to cracking. Values over 25 are considered acceptable as they indicate a greater resistance to cracking and corrosion.

In another embodiment, as shown in FIG. 1, the stress testing 110 is performed in an apparatus, such as an autoclave, where the metals and fluids are subject to simulated downhole conditions. The results from the stress testing are stored in a database 120. Logic encoded in one or more software programs is applied to the stress test results 130. The encoded logic is executed to generate a corrosion susceptibility index 180. The corrosion susceptibility index 180 comprises a scale with values between 0 and 100. The corrosion susceptibility index 180 is used to predict the susceptibility to corrosion of metals 190 exposed to fluids under stressful downhole conditions. A value greater than 25 is indicative of a greater susceptibility to corrosion. Values below 25 are considered acceptable and do not pose a significant corrosion risk.

In another embodiment, illustrated in FIG. 1, one or more specimens of the metals are tested for corrosion and cracking behavior with one or more fluids under test conditions that include applied and/or residual stress. Applied stress is stress introduced by mechanical or physical means due to use of tools or applied pressure from environment. Residual stress is stress introduced during manufacturing or processing, that is inherent in the metal sample. The stress testing 110, can be conducted by the NACE TM0177 C-ring test, the modified NACE test described above, or other methods known in the industry such as SSRT, U-bend, bent beam testing, electrochemical testing methodology, acoustical testing and testing methods utilizing strain gauges. The testing conditions are monitored in real-time by various apparatus and equipment that are well known in the industry. In one embodiment, stress testing is conducted in an autoclave and changes in temperature, pressure, pH, fluid density and gas concentrations are monitored.

The system also includes a computer with a memory, one or more processors, fluid compatibility evaluation software loaded into the computer memory, a database stored in the computer memory for holding the stress test results 120, one or more software programs loaded into computer memory for evaluating the stress test results, one or more means to execute the software programs to generate a cracking susceptibility index 140 and report generation software loaded into the computer memory. A particular computer system has not been shown because the technologies can be implemented on any of a variety of computer hardware and software systems. For example, the test data collected can reside on a single storage device, a set of devices, or a mixture of various devices of various forms. In addition to databases, data warehouses, data marts, and the like can also be used to store the data. The processing can be performed on a single computer, a set of computers, or a mixture of various computers of various forms.

The computer system comprises a computer having a database, one or more processors, fluid compatibility evaluation software containing at least one user interface screen, an input device such as a keyboard or a mouse and a display terminal. The computer can include operating system software, such as Windows NT, that permits multi-tasking and multi-processing of simultaneous running applications. In addition, the various software programs or code may be developed using a high level programming language, such as C++, and programming techniques such as object oriented programming techniques. While the disclosed architecture is discussed in terms of a single PC, it should be noted that the architecture is not limited to a single PC, but may comprise a plurality of PCs. Additionally, although the disclosed invention discusses a single PC, the system is also applicable to one or more PC's connected in LAN, WAN, web-based and peer-to-peer network configurations.

In another embodiment, to better facilitate the use of the database 120, fluid compatibility evaluation software programs loaded into the computer memory are developed from the stress test results 130. These software programs can be executed to determine the susceptibility towards cracking for the metals exposed to the fluids under downhole conditions. The fluid compatibility evaluation software presents one or more user interface screens. These screens can be used to display cracking susceptibility results. Cracking susceptibility can be depicted with one or more indicia such as words, symbols, icons, colors or combinations thereof. One or more cracking susceptibility indexes 140 can also be created to indicate cracking susceptibility for the interaction between the fluids and the metals. The cracking susceptibility index (CSI) 140 comprises an arbitrary range of numerical values which represent a quantitative relative susceptibility towards cracking for combinations of fluids and metals under specified downhole conditions. An arbitrary value is selected as a cutoff value for predicting one or more compatible fluids 150. A CSI value above the cutoff value is indicative of a high risk of EAC associated metal failure. Alternatively, a CSI value below the cutoff value would point to a low failure risk. The CSI further facilitates the selection of fluids that reduce the cracking susceptibility of the given metals under downhole conditions. The system also includes software instructions loaded into the computer memory for selecting additives for the fluids.

Figure 3:
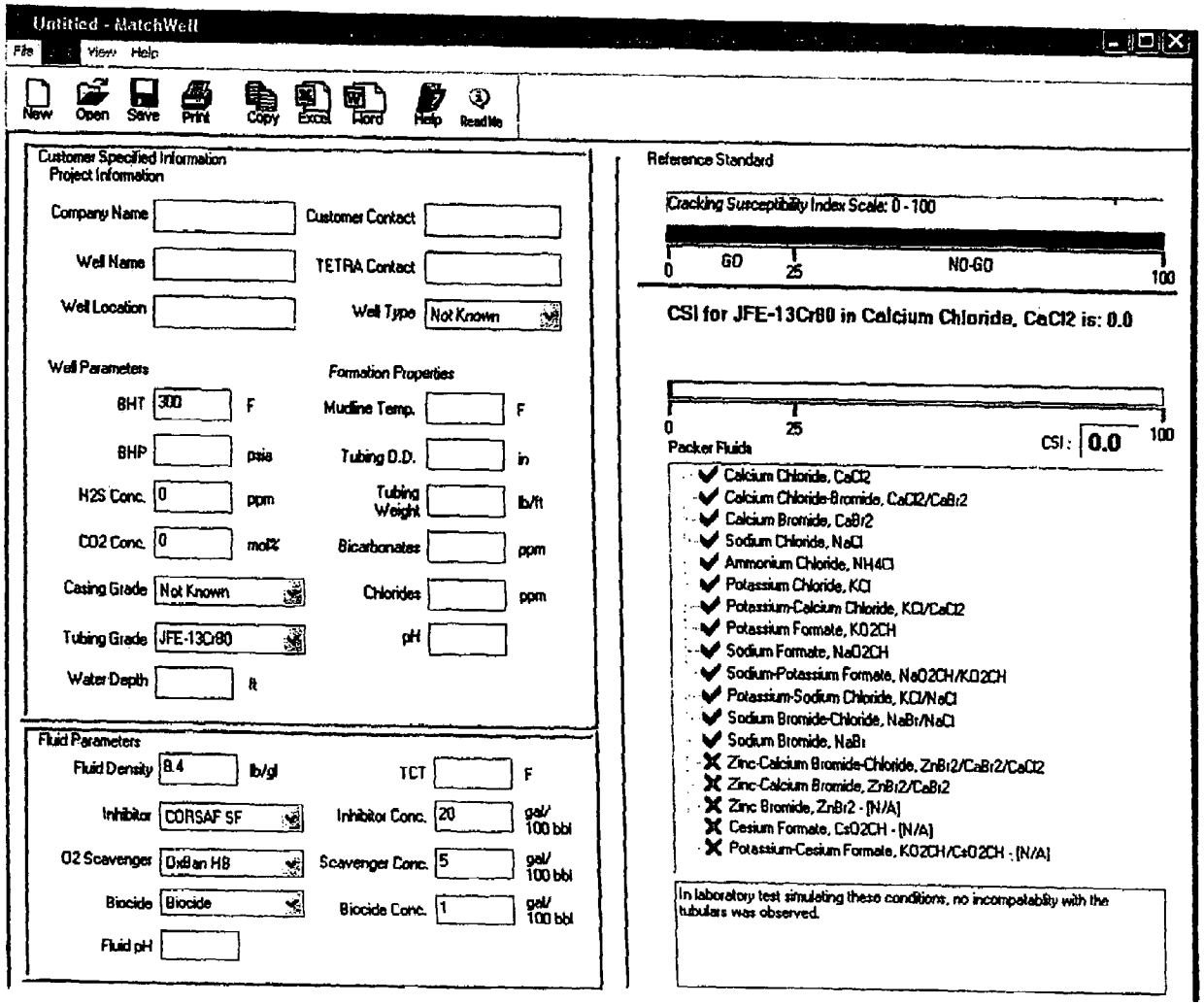
FIG. 3 depicts an exemplary screen shot of an user interface of the invention.

Referring to FIG. 3, the fluid compatibility evaluation software contains a user interface screen that is separated into two parts, A and B. The input parameters are placed on the left side of the screen, A, and the results are generated on the right side, B. The fluid compatibility evaluation software comprises code for evaluating the test results stored in the database. The computer processors execute this software code when a user makes an appropriate selection in the user interface screen of the fluid compatibility evaluation software. The processing can be any of a variety of forms, including queries, analyses, algorithms, filters, formatting, preparation for distribution, distribution, detection of events, and the like. For example, the processing can involve pulling records from the database, formatting information derived therefrom, and sending the formatted information to the one or more user interface screens. Generally speaking, the data input into the user interface screens is compared with the test results stored in the database to make a quantitative estimate of the risk encountered by selecting one or more fluids with the proposed metal to be used in the tubing or other oil field equipment. The fluid compatibility evaluation software program operates on the computer to select a list of compatible fluids based on their calculated cracking susceptibility index values and displays them on the user interface screen.

In one embodiment, as indicated in FIG. 3, the input section, A, is split into two main parts, 1) customer specified information and 2) fluid parameters. The customer specified information section, section A, comprises multiple input fields to reflect the user inputs that are provided by the customer, typically the well engineer or operator. The customer can input general project information in a designated section. Another section contains input fields for well parameters and formation properties. The well parameters can include bottom hole temperature, bottom hole pressure, hydrogen sulphide concentration, carbon dioxide concentration, metal casing grade, the tubing grade and water depth at the well site. The well engineer or well operator must supply these parameters.

The formation properties can include mudline temperature, tubing outside diameter, tubing wall thickness, bicarbonates, chlorides and the pH level. None of these fields are required to calculate the CSI. The fluid parameters include the fluid density and one or more additives for the fluids, such as corrosion inhibitors, oxygen scavengers and biocides along with their concentrations. The above parameters can be varied and modified according to the needs and desires of the well operator. In one embodiment, the software operator must provide the fluid density. Using an input device such as a keyboard, the user is required to enter the mandatory fields. Once the required values are input or changed, the user either "tabs" out or presses the "Enter" key on the keyboard, to display the results.

As depicted in FIG. 3, in one embodiment of the invention, the results are displayed in section B of the user interface. The results screen shows a list of fluids with an "X" mark or a "check" mark next to it. The "X" mark denotes that the fluid is not acceptable based on the inputs provided and the "check" mark indicates that it is acceptable. The fluids are sorted in order of increasing CSI. The fluids that are acceptable with CSI values less than 20 are on the top of the list. These are followed by fluids that are marginally acceptable and have CSI values between 20 and 25, followed by those that are not acceptable with CSI values greater 25. The fluids that are not available for the specified fluid density chosen or do not have CSI data at the conditions specified are listed at the end.

In this embodiment, CSI values for the fluid and metal combinations are also generated in the results section of the user interface. A CSI scale, shown in B, varying from 0 to 100 has also been created. For a particular metal the CSI with respect to a particular fluid varies from 0 to 100. Values of CSI below 25 are considered acceptable and the indicator shows the value with the scale colored green or the word "GO" is displayed. Values over 25 are not acceptable and the scale turns red or displays the words "NO GO." For values close to 25, the scale turns yellow to alert the customer about the proximity to the limit or displays the words "Caution—very close to the NO-GO region." In another embodiment, the scale can display different words, such as, "pass" or "fail," to indicate compatible and incompatible fluids respectively. Different words, colors, characters, symbols, or combinations thereof can also be utilized to indicate fluids that are compatible, or not, with the metals. A particular fluid can be considered not acceptable under the following three scenarios: if it is not available at the given density; under the given conditions the CSI for the selected metal with respect to the fluid is greater than 25; or for the given conditions and the selected metal CSI data is not available. Users can select each fluid to find out the individual CSI for that fluid and other details. The results screen will display the individual CSI values and the result for each fluid as the user, for example, clicks on them with a mouse, or uses the arrow key to move up or down the fluid list. The user can also double click or right-click on a fluid to obtain additional details, such as composition and additional blends, and also to generate a fluid recommendation report.

FIG. 4 depicts an exemplary fluid recommendation report of the invention. Report generation software that is loaded into the computer memory allows selected compatible fluids along with the CSI values to be exported or copied into a word processing or a spreadsheet document. The resulting fluid recommendation report indicates the CSI value and the acceptability of the specified fluid for use with the specified metal. Additives recommended for use with the fluids can also be displayed. The reports can be printed and/or saved to the computer.

The features of the computer system should not be limited to those discussed above. Clearly other features such as a help section, a periodic table lookup and various security measures, as found in most programs are included in the fluid compatibility evaluation software of the embodiment.

In another embodiment of the invention, a method for predicting cracking susceptibility of one or more metals exposed to one or more fluids, that optionally comprise one or more additives, under either applied or residual stress is disclosed. The method comprises developing a database comprising test results from stress testing the compatibility of fluids with metals under simulated oil field conditions. The test results are evaluated to determine susceptibility towards cracking for given metal and fluid combinations. Cracking susceptibility can be assessed using one or more words, numerals, symbols, icons, characters or combinations thereof.

In another embodiment of the invention, illustrated in FIG. 1, a method for selecting fluids for compatibility with specified metals exposed to oil field environments is disclosed. The fluids comprise petrochemicals, completion fluids, drilling fluids, workover fluids and packer fluids. The metals comprise metals used in oil field tools, equipment, tubing, downhole tubular goods, caps and piping. The method comprises providing a computer or a comparable data acquisition and data processing system. The computer comprises a computer memory, processors, a database, an input/output device such as a mouse and keyboard, a display terminal and software programs such as stress test evaluation software, fluid compatibility evaluation software and fluid recommendation report software. Metal specimens are tested for corrosion behavior by exposing them to fluids under test conditions that comprise simulated oil field conditions and downhole conditions. In one embodiment, the C-rings are pre-stressed, the stress comprising applied and/or residual stress. The metal specimens are preferably C-ring specimens 200, depicted in FIG. 2, that can be highly stressed to give both elastic deformation and plastic deformation of the metal specimens. The testing methodology includes subjecting the fluids and metals to variable temperature, pressure, pH, fluid density, metallurgical stress and other variable factors occurring in oil field operations.

The testing conditions can further incorporate contaminants such as nitrogen, air, hydrogen sulphide and/or carbon dioxide. These contaminants, with the exception of nitrogen, are commonly found downhole. The fluids tested optionally contain additives such as corrosion inhibitors, biocides and oxygen scavengers. The stress testing results, including corrosion cracking tendencies, can be visually inspected and/or monitored in real-time using one or more apparatus or equipment. The corrosion and cracking results are monitored in real-time by an electrochemical apparatus. During the testing, variations in downhole parameters including, pressure, pH, temperature, fluid density and gas concentration are also monitored by equipment and apparatus commonly used in the industry.

Referring again to FIG. 1, the stress testing 110 is conducted in highly corrosion resistant apparatus such as C-276 or titanium autoclaves. The results from the stress testing are stored in the computer database 120. Advantageously, the method of this invention provides for a comprehensive database comprising multiple test results for combinations of fluids and metals under variable downhole conditions. The stress test results are evaluated 130 using software programs loaded into the computer memory. Fluid compatibility evaluation software is developed from the stress test results and is loaded into the computer memory. In one embodiment, the fluid compatibility evaluation software comprises a user interface screen. Referring to FIG. 3, the user interface screen is divided into two sections, a section for inputting information, section A, and another for displaying results, section B.

The input fields are designed to receive one or more indicia of downhole conditions, such as, well parameters and fluid parameters. The well parameters include bottom hole temperature, hydrogen sulphide concentration, carbon dioxide concentration and metallurgical grades of the metals. The fluid parameters comprise fluid density and one or more additives for the fluids. The input section of the user interface also comprises fields designed to receive well specific information. Referring again to FIG. 1, computer processors execute the fluid compatibility evaluation software to generate a cracking susceptibility index (CSI) 140 that is used to predict fluids compatible for use with the specified metals 150.

The CSI comprises a range of values that represent a quantitative relative susceptibility towards cracking. An arbitrary value is designated as a cutoff value for the prediction of fluids compatible with specified metals. CSI values above the cutoff value indicate a greater susceptibility towards cracking for the given fluid and metal combination. A CSI value below the cutoff value indicates a lower susceptibility towards cracking. In another embodiment, the processors execute the fluid compatibility evaluation software to generate a cracking resistance index 160 that is used to predict the cracking resistance of the various fluid and metal combinations 170. Report generation software loaded into the computer memory can generate fluid recommendation reports based on the cracking susceptibility index. As illustrated in FIG. 4, the fluid recommendation reports rank the fluids based on the cracking susceptibility index. In one embodiment, the fluids with highest CSI values for a specified metal are ranked first followed by fluids with lower CSI values. The reports comprise compatible fluids. In an embodiment, the computer also comprises additive selection software loaded into memory. The processors execute the additive selection software to provide a report on optional additives for the fluids.

The foregoing description is illustrative and explanatory of preferred embodiments of the invention, and variations in the size, shape, materials and other details will become apparent to those skilled in the art. It is intended that all such variations and modifications, which fall within the scope or spirit of the appended claims, be embraced thereby.

The invention claimed is:

1. An accelerated method for selecting one or more compatible fluids for one or more metals exposed to the corrosive conditions present in an oil field environment, the method comprising:

contacting one or more metal specimens comprising the one or more metals with one or more test fluids under stress testing conditions simulating downhole conditions and conducted over an accelerated period of time compared to NACE standard test guidelines, the stress testing conditions comprising a stress level effective to produce both elastic and plastic deformation of the one or more metal specimens, the one or more test fluids being representative of packer fluids or completion fluids commercially used under the corrosive conditions in the oil field environment;

monitoring in real time one or more corrosion tendencies of the one or more metal specimens and producing simulated stress test data comprising pre-cracking parameters and/or cracking parameters for the one or more metal specimens; and, selecting fluids by matching the simulated stress test data with actual field conditions under which a completion fluid or frac fluid is compatible with one or more metals in an oil field environment.

2. The method of claim 1 wherein the accelerated period of time is 7 days or less.

3. The method of claim 1 further comprising obtaining the one or more test fluids from companies that manufacture the test fluids for use in the oil field environment wherein the test fluids comprise completion fluids and/or packer fluids.

4. The method of claim 3 further comprising using one or more test fluids having a density of from 8.3 lb/gal and 20.5 lb/gal.

5. The method of claim 1 further comprising evaluating the one or more stress test records to assign to the one or more test fluids a value along one or more indexes, the indexes comprising a range of arbitrary values representing corrosion and pre-cracking events, the one or more indexes each further comprising an arbitrary cutoff value for selecting the one or more compatible test fluids.

6. The method of claim 5 wherein:

the index is from 1 to 100; and, the arbitrary cutoff value is 25.

7. The method of claim 5 further comprising using one or more arbitrary cutoff values to select the one or more compatible fluids.

8. The method of claim 7 further comprising evaluating the one or more stress test records using fluid compatibility evaluation software to assign the one or more test fluids a value along the one or more indexes.

9. The method of claim 5 further comprising using the one or more stress test records to select one or more compatible fluids from among the one or more test fluids, the one or more compatible fluids being effective to minimize the risk of stress corrosion cracking along the outside of metal tubing comprising the one or more metals when exposed to the corrosive conditions present in an oil field environment.

10. The method of claim 9 wherein the stress testing conditions comprise one or more contaminants.

11. The method of claim 10 wherein the one or more contaminants comprise air, hydrogen sulphide, and/or carbon dioxide.

12. The method of claim 5 further comprising mimicking worst case downhole conditions by providing partial pressures of gases designed to mimic flow of production gases freely into the annulus of oil field tubing.

13. The method of claim 5 further comprising generating a fluid recommendation report ranking compatibility of the one or more test fluids with the one or more metals based on the one or more arbitrary cutoff values.

14. The method of claim 13 further comprising providing in the fluid recommendation report a list of one or more optional additives recommended for use with the one or more metals.

15. The method of claim 1 further comprising recommending one or more optional additives for use with the one or more fluids to be used with one or more metals.

16. The method of claim 1 further comprising:

generating a fluid recommendation report based on the one or more stress test records; and, using the fluid recommendation report to select the one or more compatible fluids.

17. The method of claim 16 further comprising providing in the fluid recommendation report a list of one or more optional additives recommended for use with the one or more metals.

18. The method of claim 1 further comprising evaluating the one or more stress test records using fluid compatibility evaluation software to select the one or more compatible fluids.

19. An accelerated method for selecting one or more compatible fluids for one or more metals exposed to the corrosive conditions present in an oil field environment, the method comprising:

contacting one or more metal specimens comprising the one or more metals with one or more test fluids under stress testing conditions simulating downhole conditions, the stress testing conditions comprising a stress level effective to produce both elastic and plastic deformation of the one or more metal specimens, wherein the one or more test fluids are representative of fluids commercially used in the oil field environment;

electrochemically monitoring in real time one or more corrosion tendencies of the one or more metal specimens, producing simulated stress test data for the one or more metal specimens, the simulated stress test data comprising cracking data and normalized pre-cracking data, the normalized precracking data comprising localized corrosion data, severe localized corrosion data, and/or pitting data;

evaluating the simulated stress test data to assign to the one or more test fluids one or more values along one or more indexes comprising a range of arbitrary values representing a quantitative relative susceptibility towards one or more phenomena of cracking susceptibility, cracking resistance, and/or corrosion susceptibility, thereby ranking compatibility of the one or more test fluids with the one or more metal specimens under the downhole conditions, the one or more indexes each comprising an arbitrary cutoff value for selecting the one or more compatible fluids; and, selecting fluids by matching the simulated stress test data with actual field conditions under which a completion fluid or frac fluid is compatible with one or more metals in an oil field environment, selecting the one or more compatible fluids based on one or more of the arbitrary cutoff values, the one or more compatible fluids being effective to minimize the risk of stress corrosion cracking along the outside of metal tubing comprising the one or more metals when exposed to the corrosive conditions present in an oil field environment.

20. The method of claim 19 further comprising evaluating one or more well parameters and/or one or more fluid parameters to select the one or more compatible fluids.

21. The method of claim 20 further comprising using fluid compatibility evaluation software to evaluate the one or more stress test records.

22. The method of claim 21 further comprising generating a fluid recommendation report indicating the one or more compatible fluids.

23. The method of claim 22 wherein the fluid recommendation report recommends a list of one or more optional additives for use with the one or more metals.

24. The method of claim 23 further comprising using one or more test fluids having a density of from 8.3 lb/gal and 20.5 lb/gal.

25. The method of claim 24 wherein:

the one or more indexes are from 1 to 100; and, the cutoff value is 25.

26. A system for selecting fluids by matching the simulated test stress data with actual field conditions for use as a completion fluid or a frac fluid that is compatible with metals for downhole use, the system comprising:

an apparatus adapted to stress test one or more metal specimens, the apparatus comprising the one or more metals in contact with one or more test fluids, the apparatus being adapted to conduct stress testing over an accelerated period of time compared to NACE standard test guidelines, the apparatus being further adapted to apply a stress level effective to produce both elastic and plastic deformation of the one or more metal specimens;

a real-time automated electrochemical monitoring apparatus in electrochemical communication with the one or more metal specimens, the electrochemical monitoring apparatus being adapted to produce one or more stress test records for the one or more metal specimens;

a database adapted to store the one or more stress test records;

one or more media comprising encoded logic for evaluating the stress test records; and, one or more apparatus adapted to execute the encoded logic to use the one or more stress test records to rank compatibility of the one or more test fluids with the one or more metals under the downhole conditions.

27. The system of claim 26 wherein the one or more media comprises fluid compatibility evaluation software.

28. The system of claim 27 wherein the one or more media further comprises additive selection software.

29. The system of claim 28 wherein the apparatus is adapted to provide one or more contaminants during the stress testing.

30. The system of claim 29 further comprising one or more user interface screens adapted to display one or more fluid compatibility rankings and to receive one or more customer specified input values.

31. The system of claim 30 wherein the one or more customer specified input values comprise one or more well parameters and one or more fluid parameters comprising fluid density and/or one or more additives.

32. The system of claim 31 wherein the one or more well parameters comprise bottom hole temperature, hydrogen sulphide concentration, carbon dioxide concentration, and/or metallurgical grades of metals.

33. The system of claim 32 further comprising report generation software adapted to generate one or more fluid recommendation reports ranking compatibility of the one or more test fluids with the one or more metals under the downhole conditions.

* * * * *

UNITED STATES PATENT AND TRADEMARK OFFICE

CERTIFICATE OF CORRECTION

PATENT NO. : 7,519,481 B2
APPLICATION NO. : 11/518757
DATED : April 14, 2009
INVENTOR(S) : Perrin et al.

It is certified that error appears in the above-identified patent and that said Letters Patent is hereby corrected as shown below:

Title page, item [73] should read as follows:
Name of Assignee: Tetra Technologies, Inc.

Title page, item [74] should read as follows:
Attorneys of Record: D'Ambrosio & Associates, P.L.L.C.,
Jo Katherine D'Ambrosio, Usha Menon Signed and Sealed this Tenth Day of November, 2009

David J. Kappos

David J. Kappos
*Director of the United States Patent and Trademark Office*